US009042793B2

(12) United States Patent
Torimoto

(10) Patent No.: US 9,042,793 B2
(45) Date of Patent: May 26, 2015

(54) TONER CASE AND IMAGE FORMING APPARATUS

(71) Applicant: KYOCERA DOCUMENT SOLUTIONS INC., Osaka-shi, Osaka (JP)

(72) Inventor: Masaru Torimoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/189,970

(22) Filed: Feb. 25, 2014

(65) Prior Publication Data

US 2014/0241759 A1 Aug. 28, 2014

(30) Foreign Application Priority Data

Feb. 28, 2013 (JP) ..... 2013-038295

(51) Int. Cl.
*G03G 15/08* (2006.01)

(52) U.S. Cl.
CPC .... *G03G 15/0865* (2013.01); *G03G 2215/0816* (2013.01); *G03G 2215/083* (2013.01)

(58) Field of Classification Search
USPC ..... 399/107, 110, 111, 119, 120, 252, 399/258–263
See application file for complete search history.

(56) References Cited

U.S. PATENT DOCUMENTS 6,026,263 A * 2/2000 Nakahata et al. ..... 399/263
7,792,470 B2 9/2010 Eto et al.

FOREIGN PATENT DOCUMENTS

JP 2005-077572 A 3/2005
JP 2007-316447 A 12/2007
JP 2008-170896 A 7/2008

* cited by examiner

*Primary Examiner* — Hoan Tran
(74) *Attorney, Agent, or Firm* — Studebaker & Brackett PC

(57) ABSTRACT

A toner case includes a case main body and an agitating member. The case main body contains a toner. The agitating member agitates the toner contained in the case main body by rotating along an inner surface of the case main body. A rib is protruded on the inner surface of the case main body along a rotation direction of the agitating member. The agitating member is provided with a slit extending along the rotation direction and located at a position corresponding to the rib.

18 Claims, 12 Drawing Sheets

TONER CASE AND IMAGE FORMING APPARATUS

INCORPORATION BY REFERENCE

This application is based on and claims the benefit of priority from Japanese Patent application No. 2013-038295 filed on Feb. 28, 2013, the entire contents of which are incorporated herein by reference.

BACKGROUND

The present disclosure relates to a toner case and an image forming apparatus provided with the toner case.

An electrographic image forming apparatus carries out the development process by supplying a toner (a developer) from a development device to an electrostatic latent image formed on the surface of a photosensitive drum or the like. The toner used in such development process is supplied from a toner case to the development device.

The aforementioned toner case usually includes a case main body that contains the toner and an agitating member that agitates the toner contained in the case main body by rotating along an inner surface of the case main body. Besides, the agitating member is usually made of a synthetic resin film such as a PET film (polyethylene terephthalate film).

However, if the agitating member is made of a synthetic resin film as described above, the agitating member becomes weak in resilience so that when the agitating member rotates, the rotation track of the agitating member deviates from the designed rotation track. As a result, the agitating member fails to reach a corner part of the case main body, and therefore a large amount of the toner will be left in the toner case (hereinafter, referred to as "used case") having ceased to be of use. Incidentally, this drawback will be improved to some extent if the agitating member is made strong in resilience. However, this will give rise to a new undesired effect that the agitating member produces large noises as it flips on the case main body when the toner in the case main body is nearly run out.

Besides, when the case main body is to be produced, it is a general practice to insert a core (movable mold) into a recess part formed in a cavity (stationary mold) and thus mold the case main body between the cavity and the core. In the case where such a molding method is adopted, it is usually the case that the contact area between the cavity and the case main body is larger than the contact area between the core and the case main body. Due to such a difference of the contact areas, the resistance that occurs when the case main body, after being molded, is released from the molds differs greatly between the cavity side and the core side. Therefore, there occurs a problem that the case main body, after being molded, cannot be released from the cavity, or the molded case main body cannot be easily released from the cavity.

SUMMARY

In accordance with an embodiment of the present disclosure, a toner case includes a case main body and an agitating member. The case main body contains a toner. The agitating member agitates the toner contained in the case main body by rotating along an inner surface of the case main body. A rib is protruded on the inner surface of the case main body along a rotation direction of the agitating member. The agitating member is provided with a slit extending along the rotation direction and located at a position corresponding to the rib.

Furthermore, in accordance with an embodiment of the present disclosure, an image forming apparatus includes a toner case. The toner case includes a case main body and an agitating member. The case main body contains a toner. The agitating member agitates the toner contained in the case main body by rotating along an inner surface of the case main body. A rib is protruded on the inner surface of the case main body along a rotation direction of the agitating member. The agitating member is provided with a slit extending along the rotation direction and located at a position corresponding to the rib.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
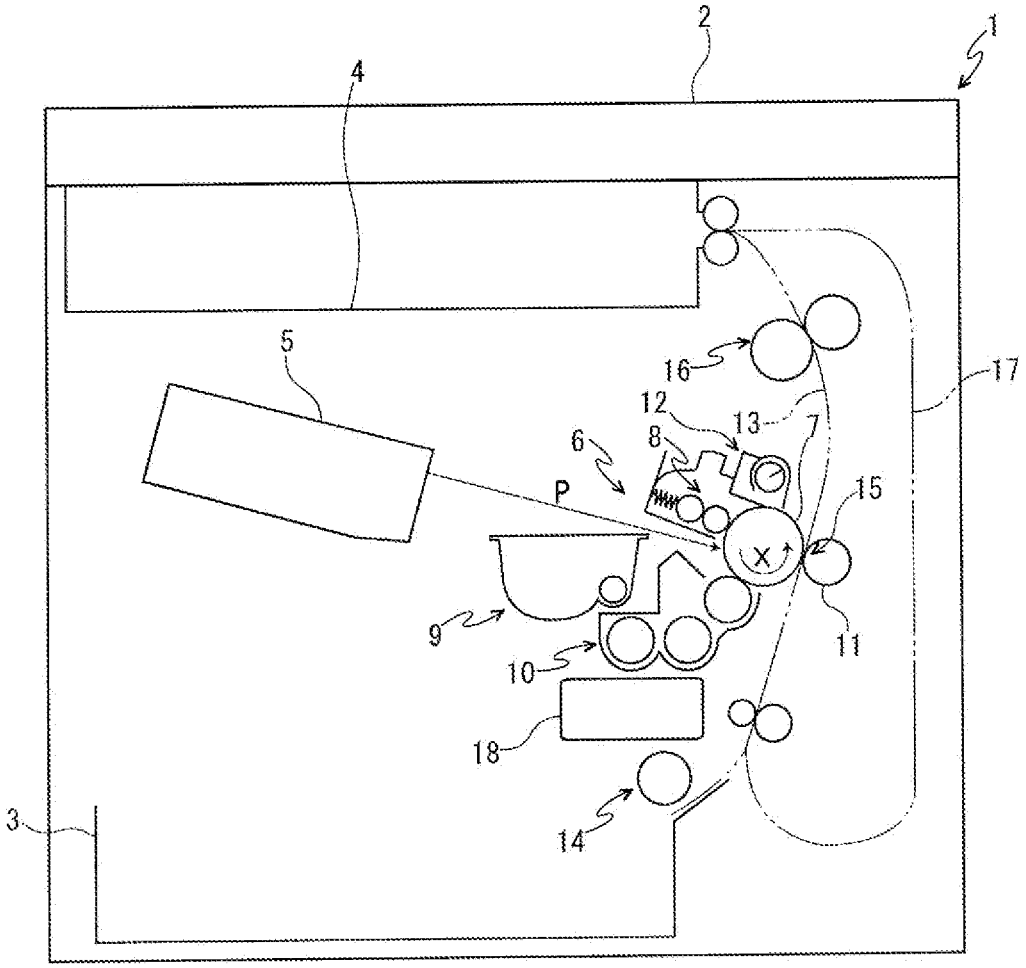
FIG. 1 is a schematic diagram schematically showing a monochrome printer in accordance with an embodiment of the present disclosure.

First, with reference to FIG. 1, the whole structure of a monochrome printer 1 (an image forming apparatus) will be described. FIG. 1 is a schematic diagram schematically showing the monochrome printer 1 in accordance with an embodiment of the present disclosure.

The monochrome printer 1 includes a box-formed printer main body 2. In a lower part of the printer main body 2, a sheet feeding cartridge 3 storing sheets (not shown) is installed and, in an upper part of the printer main body 2, a sheet ejecting tray 4 is formed.

In a left part of the printer main body 2, an exposure device 5 composed of a laser scanning unit (LSU) is installed. In a right part of the printer main body 2, an image forming part 6 is arranged. In the image forming part 6, a photosensitive drum 7 as an image carrier is rotatably installed. Around the photosensitive drum 7, a charging device 8, a development device 10 connected to a toner container 9 (toner case), a transferring roller 11, and a cleaning device 12 are located along a rotating direction (refer to an arrow X in FIG. 1) of the photosensitive drum 7. In the right lower side of the toner container 9, a waste toner bottle 18 is arranged.

In the right part of the printer main body 2, a sheet conveying path 13 is arranged from a lower side to an upper side. At an upstream end in the conveying path 13, a sheet feeder 14 is positioned. At an intermediate stream part in the conveying path 13, a transferring part 15 composed of the photosensitive drum 7 and transferring roller 11 is positioned. At a downstream part in the conveying path 13, a fixing device 16 is positioned. In the right side of the conveying path 13, an inversion path 17 for duplex printing is arranged.

Next, the operation of forming an image by the monochrome printer 1 having such a configuration will be described.

When the power is supplied to the monochrome printer 1, various parameters are initialized and initial determination, such as temperature determination of the fixing device 16, is carried out. Subsequently, in the monochrome printer 1, when image data is inputted and a printing start is directed from a computer or the like connected with the monochrome printer 1, image forming operation is carried out as follows.

First, the surface of the photosensitive drum 7 is uniformly electric-charged by the charging device 8. Then, exposure corresponding to the image data on the photosensitive drum 7 is carried out by a laser light (refer to an arrow P in FIG. 1) from the exposure device 5, thereby forming an electrostatic latent image on the surface of the photosensitive drum 7. Subsequently, the development device 10 develops the electrostatic latent image by a toner (a developer) supplied from the toner container 9.

On the other hand, the sheet fed from the sheet feeding cartridge 3 by the sheet feeder 14 is conveyed to the transferring part 15 in a suitable timing for the above-mentioned image forming operation. Then, the toner image carried on the photosensitive drum 7 is transferred onto the sheet at the transferring partly. The sheet with the transferred toner image is conveyed to a downstream side in the conveying path 13 to go forward to the fixing device 16, and then, the toner image is fixed on the sheet in the fixing device 16. The sheet with the fixed toner image is ejected from a downstream end in the conveying path 13 to the sheet ejecting tray 4. The toner remained on the photosensitive drum 7 is removed by the cleaning device 12 and stored in the waste toner bottle 18.

Next, using FIG. 2 to FIG. 4, the printer main body 2 will be described further in detail. Incidentally, an arrow Fr in FIG. 2 and FIG. 3 indicates a front side of the monochrome printer 1 (the same applies to FIG. 5 and the subsequent drawings).

Figure 2:
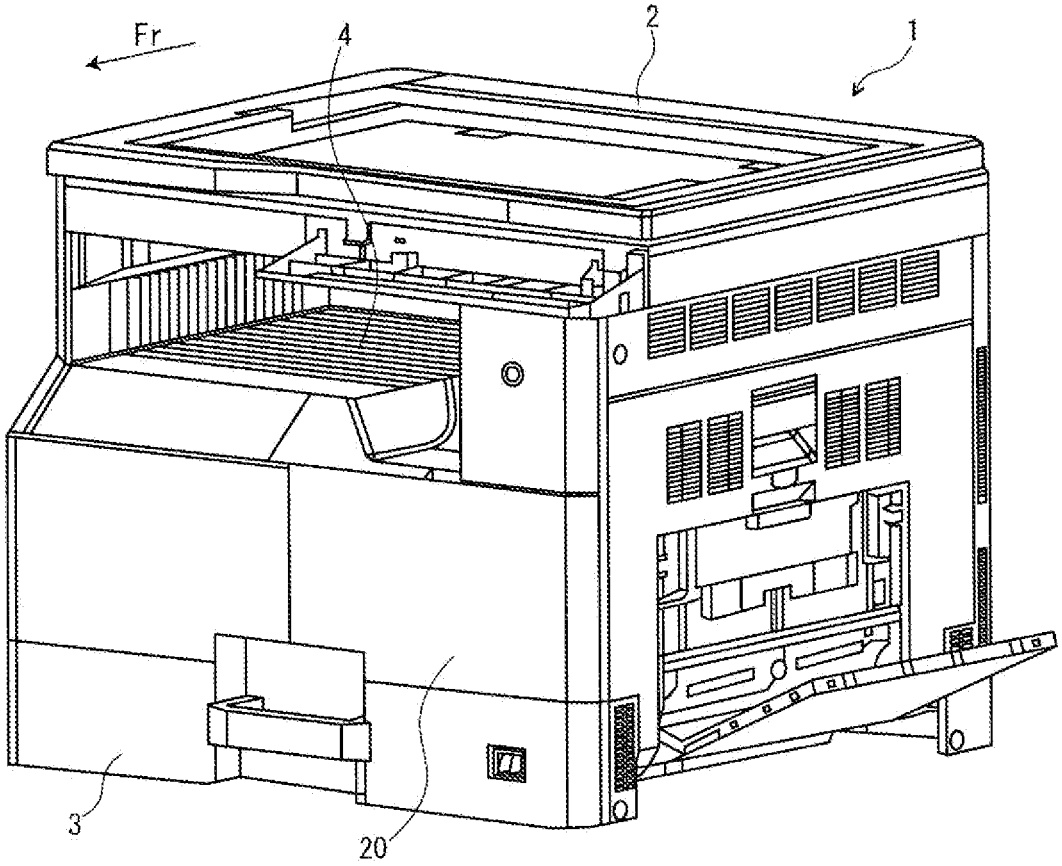
FIG. 2 is a right front perspective view showing a situation in which a front cover is closed in the monochrome printer in accordance with the embodiment of the present disclosure.
Figure 3:
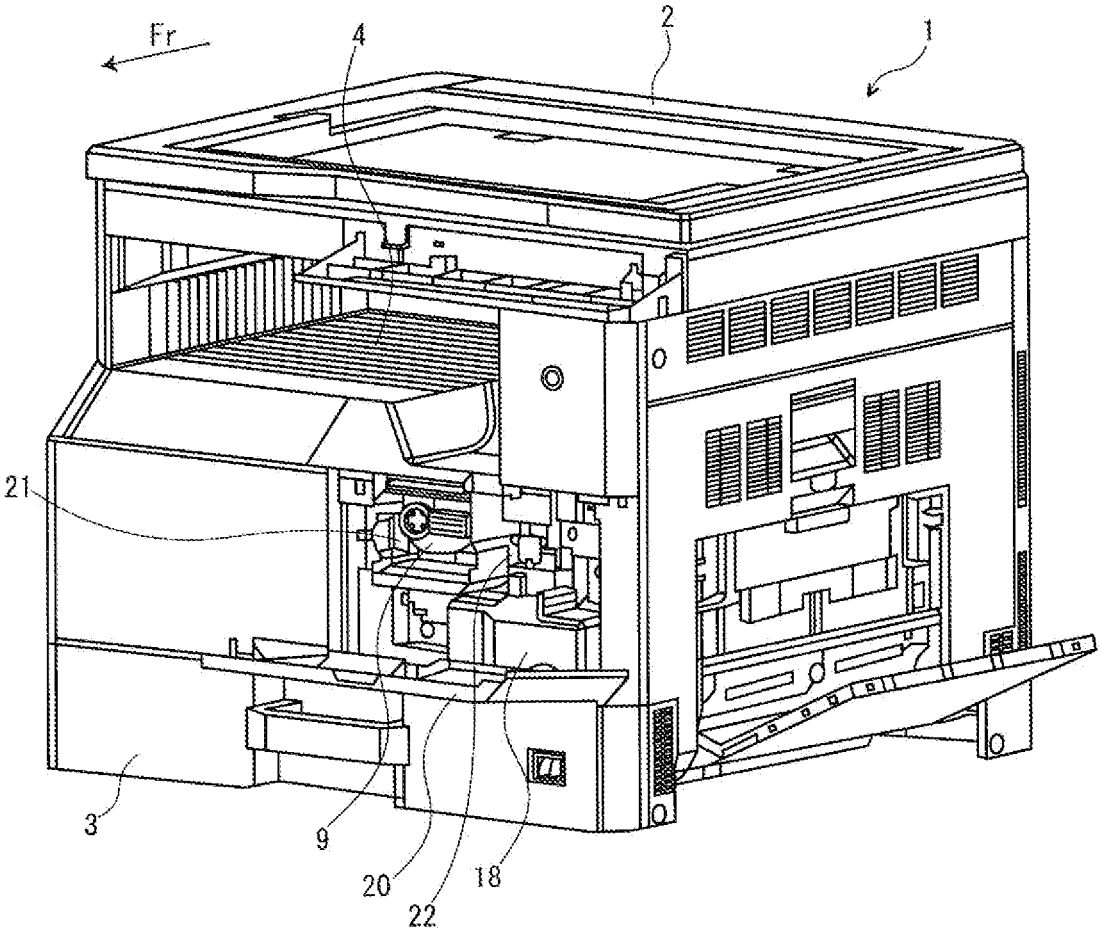
FIG. 3 is a right front perspective view showing a situation in which the front cover is opened in the monochrome printer in accordance with the embodiment of the present disclosure.

As shown in FIG. 2 and FIG. 3, a front cover 20 is attached to a right side part of a front surface of the printer main body 2. The front cover 20 is located above the sheet feeding cartridge 3 and below the sheet ejecting tray 4. The front cover 20 is constructed so as to open and close by rotating with a lower end side being a support point.

Figure 4:
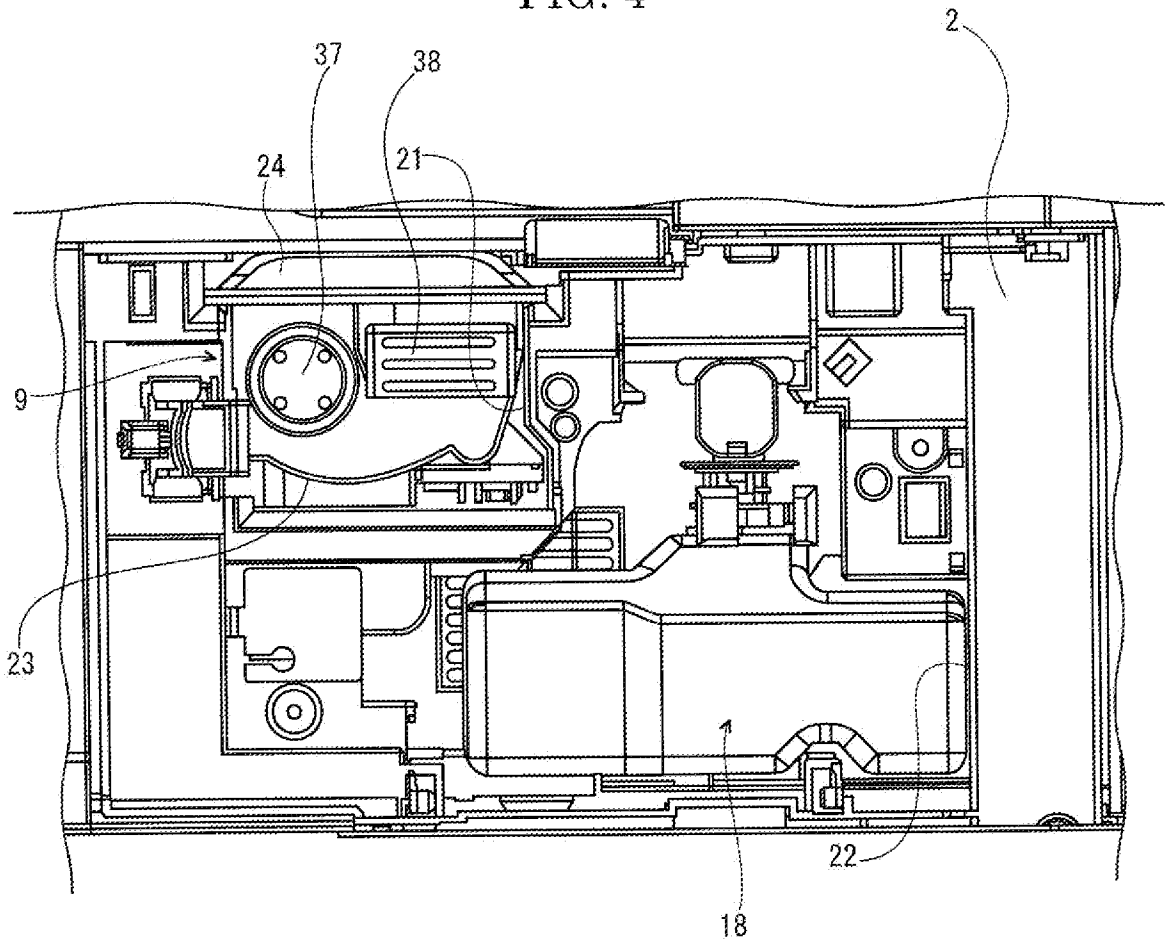
FIG. 4 is a front view showing a toner container, a waste toner bottle, and their surroundings in the monochrome printer in accordance with the embodiment of the present disclosure.

As shown in FIG. 3 and FIG. 4, a container attachment part 21 is formed in a portion of the printer main body 2 which is covered by the front cover 20 (not shown in FIG. 4). The toner container 9 (described in detail later) is detachably attached to the container attachment part 21, and the toner container 9 can be removed from the container attachment part 21 by opening the front cover 20.

A bottle attachment part 22 is formed in a portion of the printer main body 2 which is covered by the front cover 20. The bottle attachment part 22 is located at a right lower side of the container attachment part 21. The waste toner bottle 18 is detachably attached to the bottle attachment part 22, and the waste toner bottle 18 can be removed from the bottle attachment part 22 by opening the front cover 20.

Figure 5:
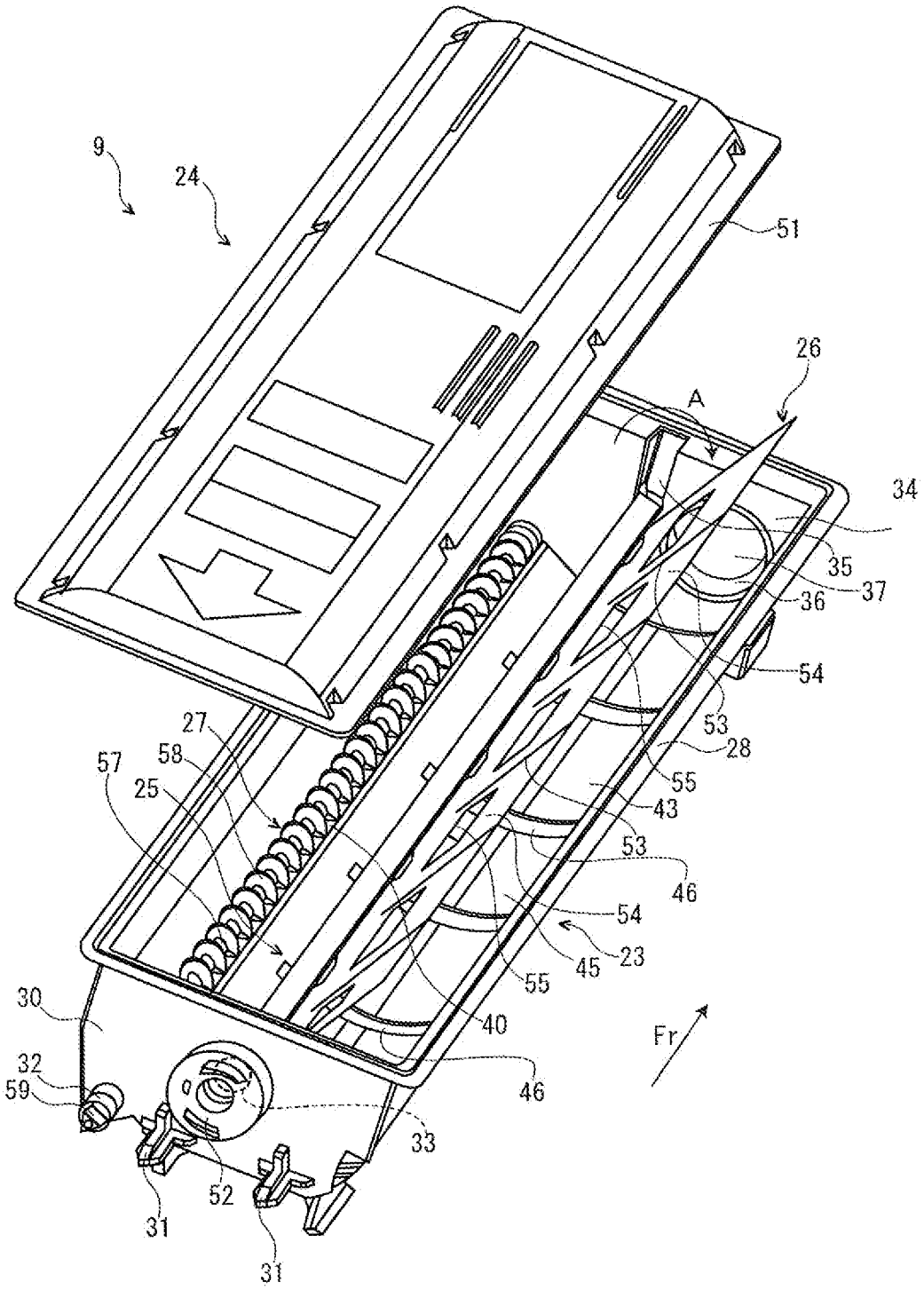
FIG. 5 is a rear upper perspective view of the toner container with a case main body and a lid body separated from each other in the monochrome printer in accordance with the embodiment of the present disclosure.

Next, using FIG. 5 to FIG. 10, the toner container 9 will be described in detail. Incidentally, since FIG. 5 is a rear upper perspective view, the left and right positional relation in the drawing is opposite to the actual left and right positional relation. Besides, an arrow A provided in drawings indicates the counterclockwise direction in a front view (the clockwise direction in a back view). Hereinafter, this direction will be called as a rotation direction A.

As shown in FIG. 5, the toner container 9 includes a case main body 23 having a box shape with an open upper surface, a lid body 24 that covers the upper surface of the case main body 23, an attachment frame 25 (attachment member) housed in a substantially middle part of the case main body 23, an agitating paddle 26 (agitating member) attached to the attachment frame 25, and a conveying screw 27 (conveying member) housed in a lower right part of the case main body 23 (a lower left part in the drawing of FIG. 5).

Firstly, the case main body 23 will be described. The case main body 23 contains the toner. The case main body 23 is made of, for example, resin, and has an elongated shape in a front and rear direction. An upper end outer periphery of the case main body 23 is provided with a main body side flange part 28. A pair of left and right mounting protrusions 31 are protruded rearward from a lower end part of a rear end wall 30 of the case main body 23. A cylindrical penetrating tubular part 32 is provided in a lower right portion of the rear end wall 30 of the case main body 23 (a lower left portion in the drawing of FIG. 5). A substantially central portion of the rear end wall 30 of the case main body 23 is provided with a penetrating hole 33.

Figure 6:
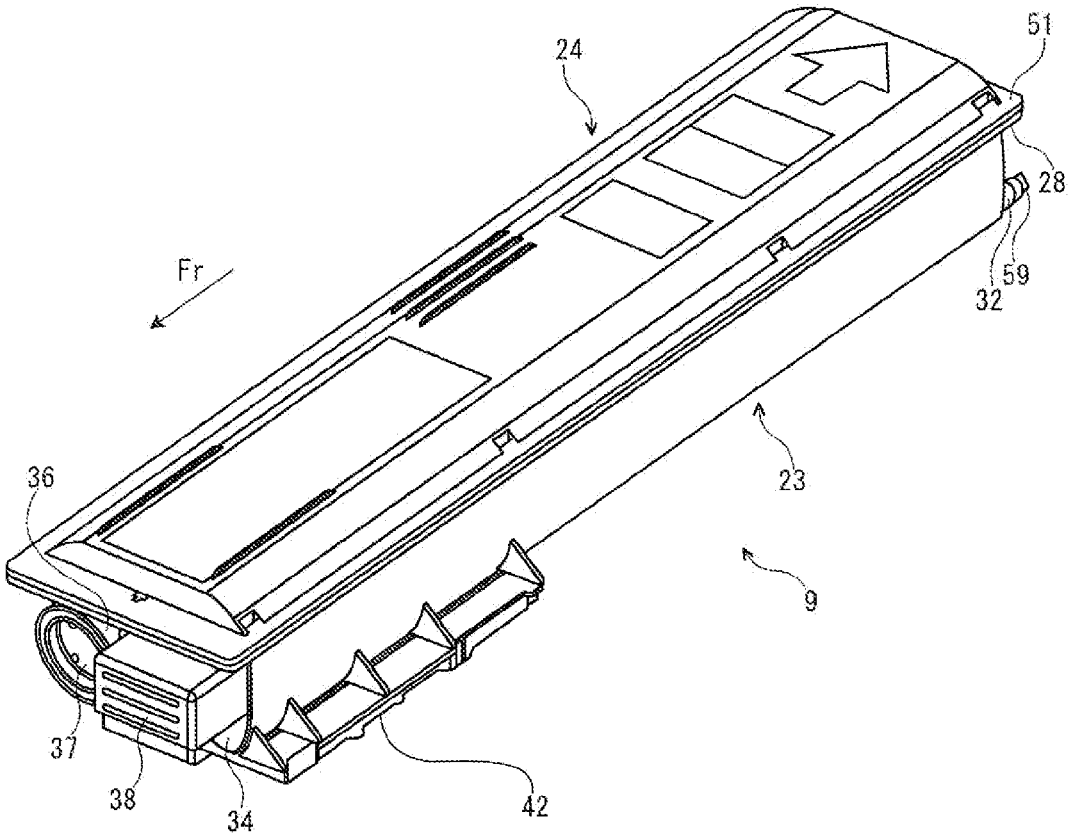
FIG. 6 is a right upper perspective view showing the toner container in the monochrome printer in accordance with the embodiment of the present disclosure.

A rear surface (inner surface) of a front end wall 34 of the case main body 23 is provided with an engagement groove 35 formed at a middle position in the left and right direction. The engagement groove 35 extends from an upper end part of the front end wall 34 to a middle part thereof in an up and down direction. As shown in FIG. 6, a left side part of the front end wall 34 of the case main body 23 is provided with a filling opening 36 for filling the inside of the case main body 23 with the toner. The filling opening 36 is closed by a cap 37. A right side portion of the front end wall 34 of the case main body 23 is provided with a handle 38 protruded forward.

Figure 7:
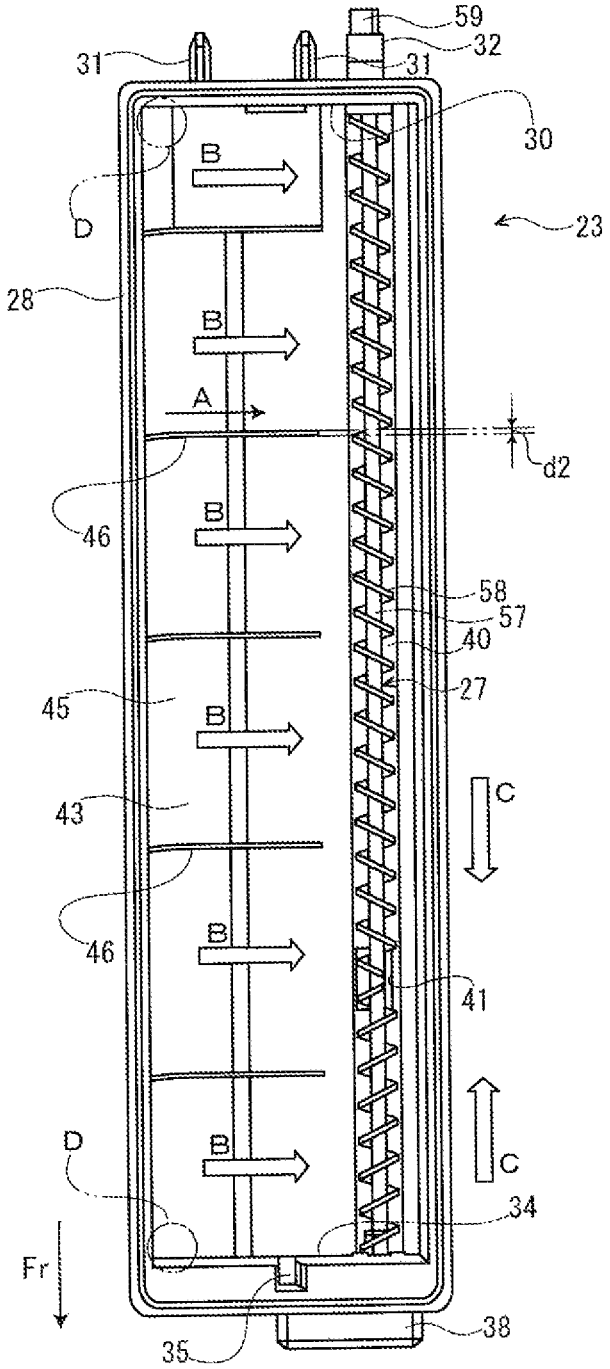
FIG. 7 is a plan view showing the case main body and a conveying screw of the toner container in the monochrome printer in accordance with the embodiment of the present disclosure.
Figure 8:
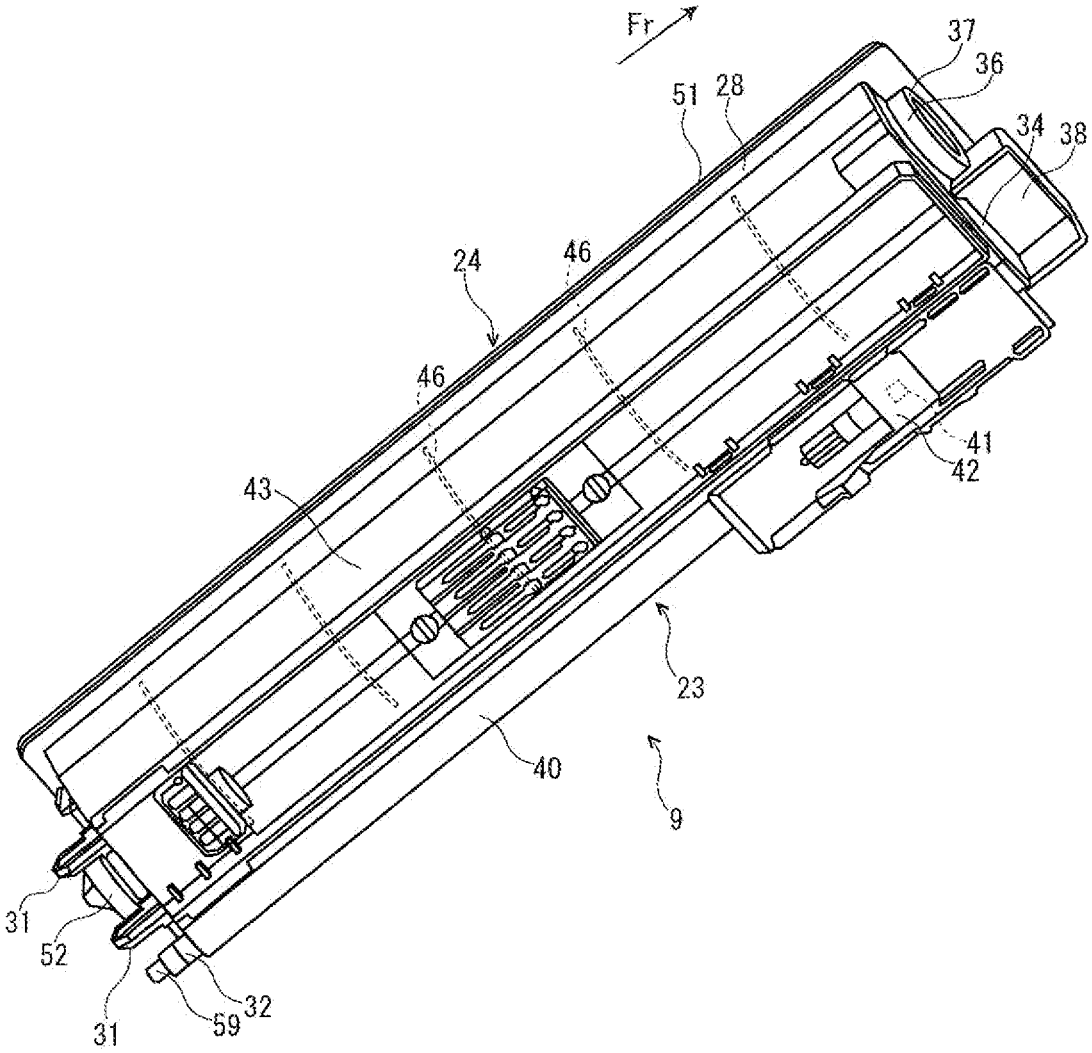
FIG. 8 is a lower perspective view showing the toner container in the monochrome printer in accordance with the embodiment of the present disclosure.

As shown in FIG. 7, a right side portion of the case main body 23 is provided with a discharge duct part 40. The discharge duct part 40 is curved downward in an arc shape. A front part of the discharge duct part 40 is provided with a discharge port 41 for discharging the toner from the case main body 23. As shown in FIG. 8, a lower side of the discharge port 41 is covered with a shutter 42 that is capable of opening or closing the discharge port 41.

Figure 9:
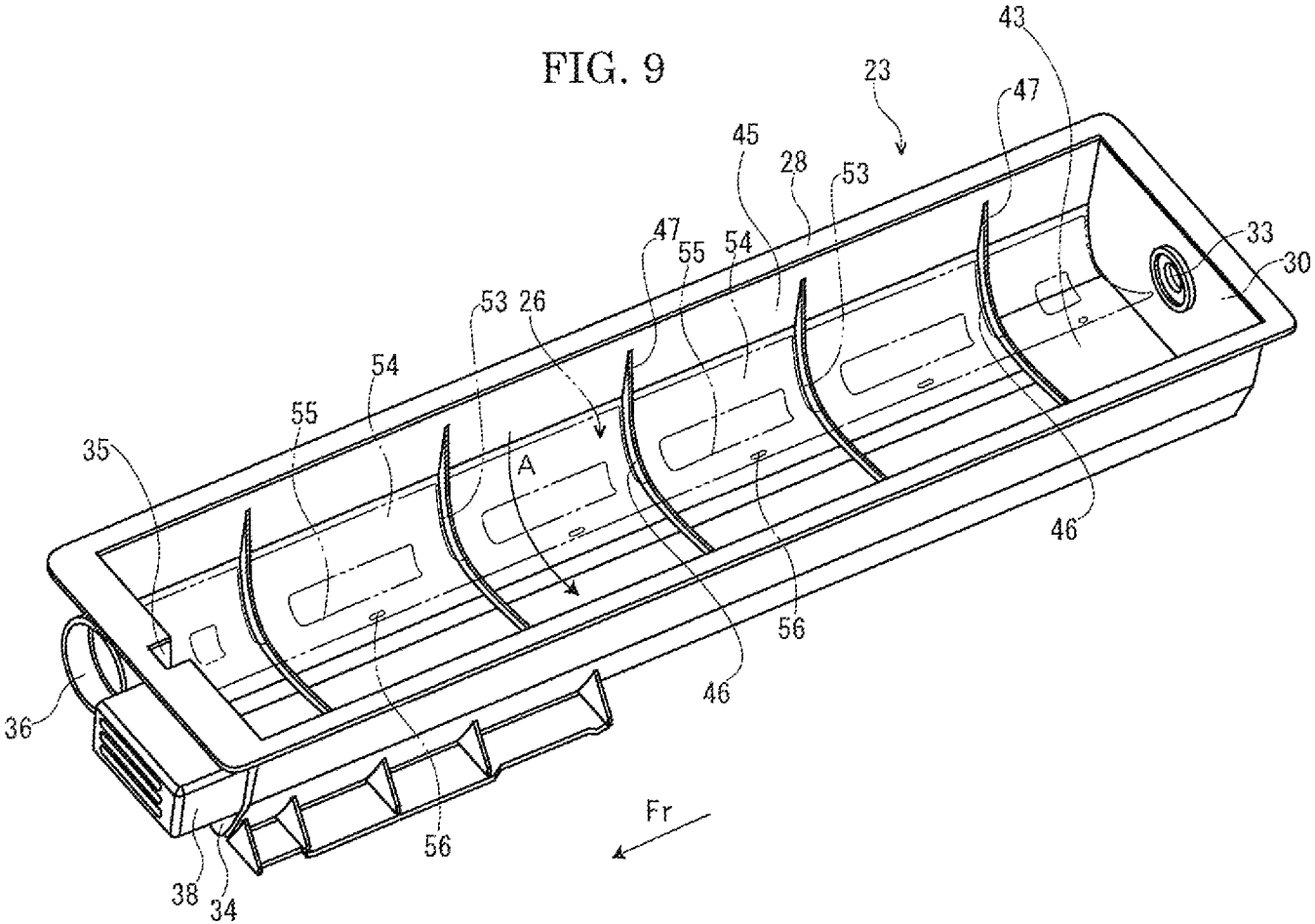
FIG. 9 is a right upper perspective view showing the case main body of the toner container in the monochrome printer in accordance with the embodiment of the present disclosure.

As shown in FIG. 7, in the case main body 23, a toner containing part 43 is formed at the left side of the discharge duct part 40. As shown in FIG. 9, the toner containing part 43 is curved leftward and downward in an arc shape.

On an inner surface 45 of the toner containing part 43, a plurality of (five in this embodiment) ribs 46 are protruded along the rotation direction A. In this embodiment, the ribs 46 are provided in parallel with the rotation direction A. The ribs 46 are disposed at intervals in the front and rear direction. Incidentally, as shown in FIG. 8, on an outer surface of the toner containing part 43, portions that correspond to the ribs 46 are not hollowed inward.

As shown in FIG. 9, each rib 46 is curved in the arc shape along the shape of the toner containing part 43. An upstream end part of each rib 46 in the rotation direction A is provided with a guide part 47. The guide part 47 has a tapered shape, that is, a protruded height of the guide part 47 from the inner surface 45 of the toner containing part 43 gets smaller toward the upstream side in the rotation direction A.

Next, the lid body 24 will be described. As shown in FIG. 5 and the like, the lid body 24 has a rectangular shape elongated in the front and rear direction. An outer periphery of the lid body 24 is provided with a lid body side flange part 51 that corresponds in shape to the main body side flange part 28 of the case main body 23. The main body side flange part 28 and the lid body side flange part 51 are ultrasonically fused so that the case main body 23 and the lid body 24 are consolidated (see FIG. 6).

Next, the attachment frame 25 will be described. As shown in FIG. 5, the attachment frame 25 has a frame platy shape elongated in the front and rear direction. A front end part of the attachment frame 25 is engaged with the engagement groove 35 formed in the front end wall 34 of the case main body 23. A rear side part of the attachment frame 25 penetrates through the penetrating hole 33 that is formed in the rear end wall 30 of the case main body 23. Due to this construction, the attachment frame 25 is rotatably supported by the case main body 23. A rear end part of the attachment frame 25 is protruded from the rear end wall 30 of the case main body 23 to the rear side (outer side) of the rear end wall 30. A first drive coupling 52 is fixed to this protruded portion of the attachment frame 25.

Next, the agitating paddle 26 will be described. The agitating paddle 26 is made of, for example, a synthetic resin film, such as a PET film (polyethylene terephtahlate film), and has flexibility. For the agitating paddle 26, for example, Lumirror may be used.

Figure 10:
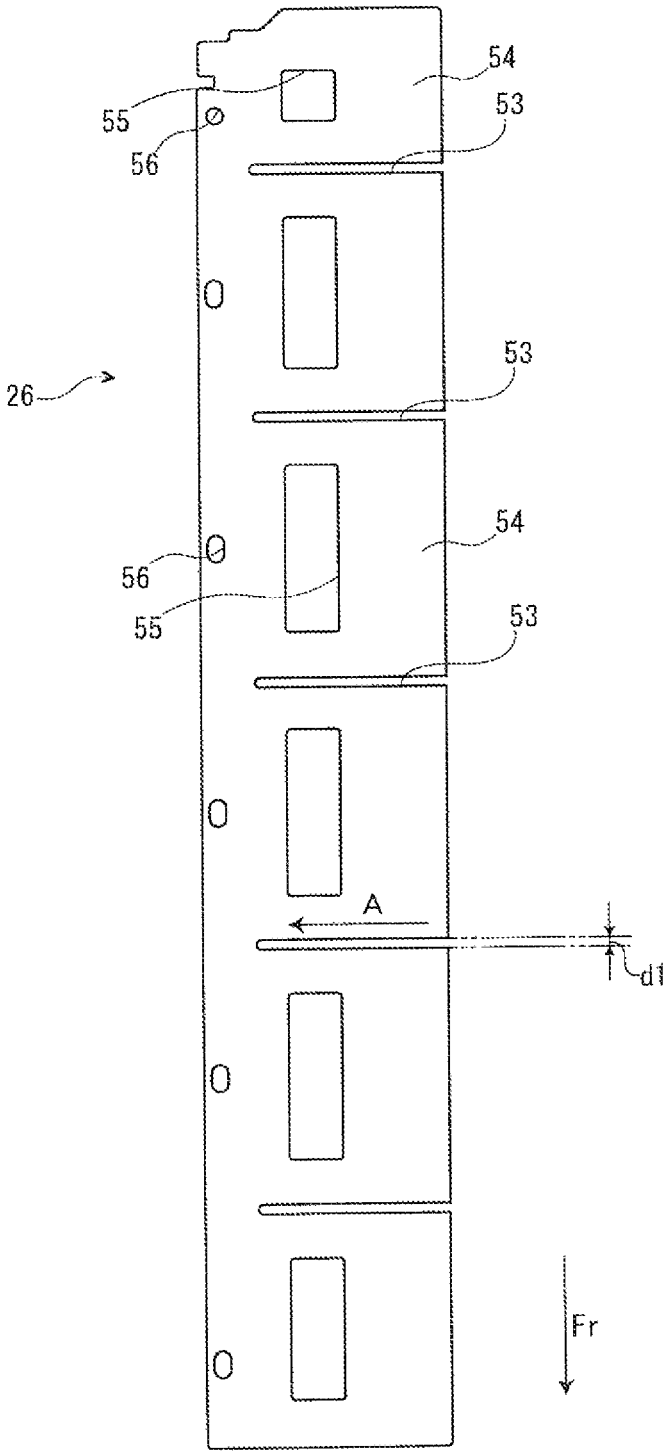
FIG. 10 is a plan view showing an agitating paddle of the toner container in the monochrome printer in accordance with the embodiment of the present disclosure.

As shown in FIG. 10, the agitating paddle 26 has an elongated shape in the front and rear direction. The agitating paddle 26 is provided with a plurality of (five in this embodiment) slits extending along the rotation direction A. In this embodiment, the slits 53 are formed in parallel with the rotation direction A. The slits 53 extend from one end part of the agitating paddle 26 in its width direction (a right end part in the drawing of FIG. 10) to one side part opposite to the one end part in the width direction (a left side part in the drawing of FIG. 10). The slits 53 are located at positions in the front and rear direction which correspond to the ribs 46 provided on the case main body 23. A front and rear width d1 of each slit 53 (see FIG. 10) is larger than a front and rear width d2 of each rib 46 (see FIG. 7).

As shown in FIG. 10, the agitating paddle 26 is provided with a plurality of (six in this embodiment) tongue pieces 54 that are divided by the slits 53. The tongue piece 54 located at rear end is smaller in the front and rear width than the other tongue pieces 54. Each of the tongue pieces 54 is provided with a quadrangular window part 55. The other end part of the agitating paddle 26 in the width direction (the left end part in the drawing of FIG. 10) is provided with attachment holes 56 that are formed at positions that correspond to the tongue pieces 54. The attachment holes 56 are provided at intervals in the front and rear direction. Then, by engaging the attachment holes 56 with six attachment parts (not shown) provided on the attachment frame 25, the other end part of the agitating paddle 26 in the width direction is attached to the attachment frame 25 along the front and rear direction (see FIG. 5).

Next, the conveying screw 27 will be described. As shown in FIG. 7, the conveying screw 27 has an elongated shape in the front and rear direction. The conveying screw 27 is provided with a rod-shaped rotating shaft 57 and a helical fin 58 provided coaxially on an outer periphery of the rotating shaft 57.

The rotating shaft 57 has an elongated shape in the front and rear direction. From a front end part to a rear part of the rotating shaft 57 is housed in the discharge duct part 40 of the case main body 23. The front end part of the rotating shaft 57 is supported by the front end wall 34 of the case main body 23, and a rear side part of the rotating shaft 57 penetrates through the penetrating tubular part 32 of the rear end wall 30 of the case main body 23. Due to this construction, the conveying screw 27 is rotatably supported by the case main body 23. A rear end part of the rotating shaft 57 is protruded from the rear end wall 30 of the case main body 23 to the rear side (outer side) of the rear end wall 30. A second drive coupling 59 is fixed to this protruded portion of the rotating shaft 57.

The fin 58 is housed in the discharge duct part 40 of the case main body 23. The helical direction of a portion of the fin 58 located forward of the discharge port 41 and the helical direction of a portion thereof located rearward of the discharge port 41 are opposite to each other.

With regard to the toner container 9 constructed as described above, an operation performed when toner is discharged from the case main body 23 will be described.

When the toner container 9 is attached to the container attachment part 21 of the printer main body 2, the shutter 42 moves from a position at which the shutter 42 closes the discharge port 41 to a position at which the shutter 42 opens the discharge port 41. In such a situation, when the first drive coupling 52 is rotated by a drive source such as an electric motor (not shown), the rotation thereof is transmitted to the attachment frame 25, so that the attachment frame 25 rotates in the rotation direction A. In connection with this rotation, the agitating paddle 26 attached to the attachment frame 25 rotates in the rotation direction A together with the attachment frame 25. At that time, the agitating paddle 26 rotates along the inner surface 45 of the toner containing part 43 of the case main body 23 while frictionally sliding on the inner surface 45, whereby the toner contained in the toner containing part 43 of the case main body 23 is agitated. In connection with this agitation, the toner contained in the toner containing part 43 of the case main body 23 moves toward the discharge duct part 40 as indicated by arrows B in FIG. 7.

Besides, when the second drive coupling 59 is rotated by the aforementioned drive source (not shown), the rotation thereof is transmitted to the conveying screw 27, so that the conveying screw 27 rotates. As the conveying screw 27 rotates in this manner, the toner having flown into the discharge duct part 40 is conveyed toward the discharge port 41 as indicated by arrows C in FIG. 7. The toner conveyed toward the discharge port 41 in this manner is discharged from the case main body 23 through the discharge port 41, and is supplied to the development device 10.

The provision of the agitating paddle 26 in the toner container 9 as described above makes it possible to scrape and gather the toner in the toner containing part 43 to the discharge duct part 40. Therefore, the amount of the toner left in the toner containing part 43 can be reduced in comparison with the case where the toner container 9 is provided merely with the conveying screw 27, not with an agitating paddle. However, since the agitating paddle 26 is made of a synthetic resin film as described above, there is risk that when the agitating paddle 26 rotates, the agitating paddle 26 may deform and the rotation track of the agitating paddle 26 may deviate from the designed rotation track. If the rotation track of the agitating paddle 26 thus deviates, the agitating paddle 26 may fail to reach corner parts of the case main body 23 (e.g., a portion D in FIG. 7), and therefore there is risk that the toner is left in the corner parts of the case main body 23.

However, in this embodiment, a plurality of the ribs 46 are protruded on the inner surface 45 of the toner containing part 43 of the case main body 23 along the rotation direction A of the agitating paddle 26. Therefore, the ribs 46 guide the agitating paddle 26 along the rotation direction A, so that the rotation track of the agitating paddle 26 can be corrected. In connection with this, it becomes possible to make the agitating paddle 26 reach the corner parts of the case main body 23, and it becomes possible to enhance the agitating performance of the agitating paddle 26. Therefore, the toner inside the case main body 23 can be consumed as thoroughly as possible, and the amount of the toner left in the used case can be reduced.

Besides, since the ribs 46 are provided in parallel with the rotation direction A, it becomes possible to certainly guide the agitating paddle 26 along the rotation direction A. Besides, since the upstream end part of each rib 46 in the rotation direction A is provided with the guide part 47, the agitating paddle 26 can be prevented from being caught by a rib 46 and therefore the agitating paddle 26 can be smoothly rotated.

Besides, the agitating paddle 26 is provided with the slits 53 that are located at positions corresponding to the ribs 46 and that extend along the rotation direction A (see FIG. 9). Therefore, it becomes possible to enhance the function of the ribs 46 guiding the agitating paddle 26, and the agitating paddle 26 can be more certainly made to reach the corner parts of the case main body 23.

Besides, since the agitating paddle 26 is attached to the attachment frame 25 and rotates together with the attachment frame 25, it becomes possible to certainly rotate the agitating paddle 26. Besides, the agitating paddle 26 is made of a synthetic resin film, and has flexibility. Therefore, the agitating paddle 26 more easily follows the shape of the inner surface 45 of the toner containing part 43 of the case main body 23.

Figure 11:
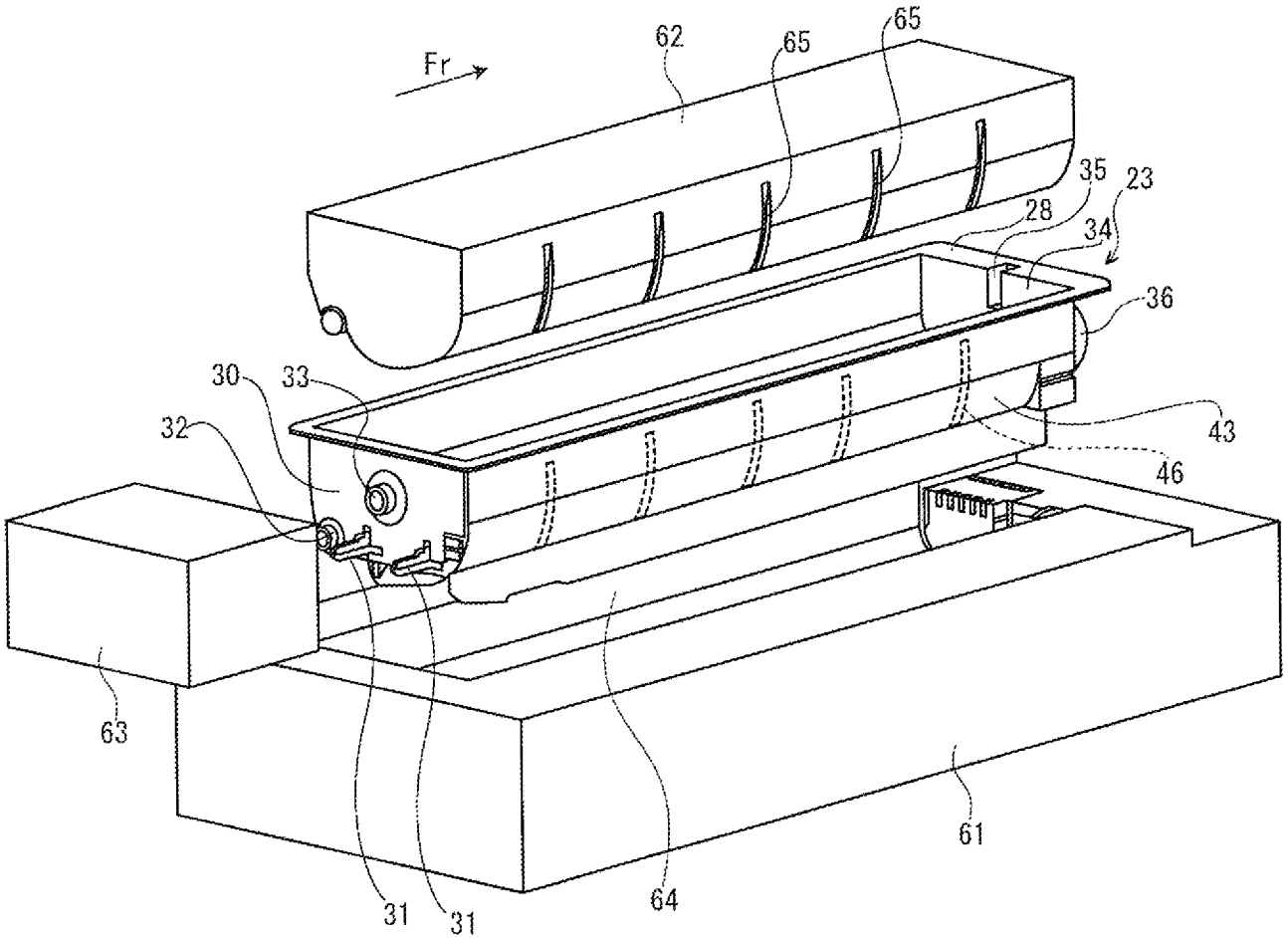
FIG. 11 is a left rear perspective view showing molds for molding the case main body of the toner container in the monochrome printer in accordance with the embodiment of the present disclosure.

Next, a method of producing the case main body 23 of the toner container 9 constructed as described above will be described using FIG. 11.

A mold for molding the case main body 23 is composed of a cavity 61, a core 62 disposed on an upper side of the cavity 61, and a slide 63 disposed at a rear side of the cavity 61.

The cavity 61 is a stationary mold. The cavity 61 is provided with a recess part 64 whose upper surface is open. The core 62 is provided so as to be capable of being raised and lowered relative to the cavity 61. On an outer peripheral surface of the core 62, a plurality of (five in this embodiment) groove parts 65 for molding the ribs 46 of the case main body 23 are formed at intervals in the front and rear direction. The slide 63 is provided so as to be slidable in the front and rear direction relative to the cavity 61, and the rear surface side of the rear end wall 30 of the case main body 23 can be molded by the slide 63.

To produce the case main body 23 of the toner container 9 constructed as described above, the core 62 is inserted into the recess part 64 of the cavity 61, and then the case main body 23 is molded between the cavity 61 and the core 62. In this case, the contact area between the cavity 61 and the case main body 23 is usually larger than the contact area between the core 62 and the case main body 23. Due to such a difference of the contact areas, the resistance that occurs when the case main body 23, after being molded, is released from the molds differs greatly between the cavity 61 side and the core 62 side. Therefore, there occurs a problem that the case main body 23, after being molded, cannot be released from the cavity 61, or the molded case main body 23 cannot easily be released from the cavity 61.

However, in this embodiment, the groove parts 65 for molding the ribs 46 of the case main body 23 are formed in the outer peripheral surface of the core 62. In connection with this, the contact area between the core 62 and the case main body 23 becomes larger. Therefore, it becomes possible to bring the contact area between the core 62 and the case main body 23 closer to the contact area between the cavity 61 and the case main body 23. Therefore, it becomes possible to prevent a situation in which, because the contact area between the core 62 and the case main body 23 and the contact area between the cavity 61 and the case main body 23 are different, mold release failure occurs or release of the molded case main body 23 from the cavity 61 becomes difficult. In connection with this, it becomes possible to improve the work efficiency in the production of the case main body 23.

Figure 12:
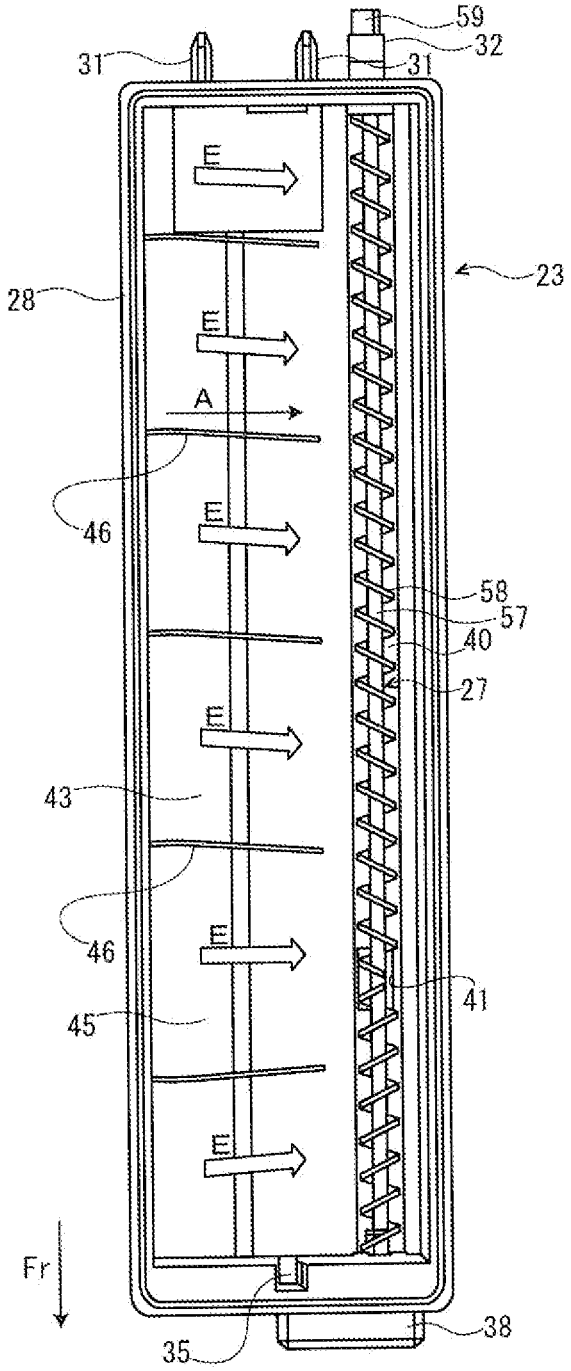
FIG. 12 is a plan view showing a case main body and a conveying screw of a toner container in a monochrome printer in accordance with another embodiment of the present disclosure.

In the embodiment, the ribs 46 of the case main body 23 are provided in parallel with the rotation direction A. However, in another embodiment, as shown in FIG. 12, ribs 46 may be inclined to the discharge port 41 side toward a downstream side in the rotation direction A. Adoption of this construction allows the toner contained in the toner containing part 43 of the case main body 23 to be moved toward the discharge port 41 side by the agitating paddle 26 (see arrows E in FIG. 12). Therefore, the toner discharging performance can be enhanced.

Besides, in another embodiment, ribs 46 may be inclined to a central part of the case main body 23 in the longitudinal direction of the case main body 23 toward a downstream side in the rotation direction A. Adoption of this construction makes it possible for the agitating paddle 26 to gather the toner toward the central part of the case main body 23 in the longitudinal direction, so that the amount of toner left in two end portions of the case main body 23 in the longitudinal direction can be reduced.

As is apparent from the foregoing description, being "along the rotation direction A of the agitating paddle 26" does not only cover the situation that the ribs 46 are parallel with the rotation direction A of the agitating paddle 26, but also covers the situation that the ribs 46 are inclined to the rotation direction A of the agitating paddle 26 within such a range that the ribs extend along the rotation direction A of the agitating paddle 26.

Although in the embodiment, the construction of the present disclosure is applied to the toner container 9, the construction of the present disclosure may also be applied to a toner case interposed between the toner container 9 and the development device 10 (a generally termed "intermediate hopper") in another embodiment.

Although the embodiment was described in a case where ideas of the disclosure are applied to the monochrome printer 1, as a furthermore embodiment, the ideas of the disclosure may be applied to another image forming apparatus such as a color printer, a copying machine, a facsimile or a multifunction peripheral.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A toner case comprising:

a case main body configured to contain a toner; and an agitating member configured to agitate the toner contained in the case main body by rotating along an inner surface of the case main body, wherein a rib is protruded on the inner surface of the case main body along a rotation direction of the agitating member, and the agitating member is provided with a slit extending along the rotation direction and located at a position corresponding to the rib.

2. The toner case according to claim 1, wherein the rib is provided in parallel with the rotation direction.

3. The toner case according to claim 1, wherein the case main body includes a discharge port discharging the toner, and the rib is inclined to the discharge port side toward a downstream side in the rotation direction.

4. The toner case according to claim 1, wherein an upstream end part of the rib in the rotation direction is provided with a guide part, and protruded height of the guide part from the inner surface of the case main body gets smaller toward an upstream side in the rotation direction.

5. The toner case according to claim 1, further comprising an attachment member rotatably supported by the case main body, wherein the agitating member is configured to be attached to the attachment member and rotate together with the attachment member.

6. The toner case according to claim 1, wherein the agitating member is made of a synthetic resin film, and has flexibility.

7. The toner case according to claim 1, wherein a width of the slit is larger than a width of the rib.

8. The toner case according to claim 1, wherein the slit extends from one end part of the agitating member in a width direction to one side part opposite to the one end part of the agitating member in the width direction.

9. The toner case according to claim 1, further comprising a conveying member rotatably supported by the case main body, wherein the case main body includes:

a discharge duct part in which the conveying member is housed; and a toner containing part on which the agitating member frictionally slides, and the rib is provided on the toner containing part.

10. An image forming apparatus comprising:

a toner case configured to include:

a case main body configured to contain a toner; and an agitating member configured to agitate the toner contained in the case main body by rotating along an inner surface of the case main body, wherein a rib is protruded on the inner surface of the case main body along a rotation direction of the agitating member, and the agitating member is provided with a slit extending along the rotation direction and located at a position corresponding to the rib.

11. The image forming apparatus according to claim 10, wherein the rib is provided in parallel with the rotation direction.

12. The image forming apparatus according to claim 10, wherein the case main body includes a discharge port discharging the toner, and the rib is inclined to the discharge port side toward a downstream side in the rotation direction.

13. The image forming apparatus according to claim 10, wherein an upstream end part of the rib in the rotation direction is provided with a guide part, and protruded height of the guide part from the inner surface of the case main body gets smaller toward an upstream side in the rotation direction.

14. The image forming apparatus according to claim 10, wherein the toner case further includes an attachment member rotatably supported by the case main body, and the agitating member is configured to be attached to the attachment member and rotate together with the attachment member.

15. The image forming apparatus according to claim 10, wherein the agitating member is made of a synthetic resin film, and has flexibility.

16. The image forming apparatus according to claim 10, wherein a width of the slit is larger than a width of the rib.

17. The image forming apparatus according to claim 10, wherein the slit extends from one end part of the agitating member in a width direction to one side part opposite to the one end part of the agitating member in the width direction.

18. The image forming apparatus according to claim 10, wherein the toner case further includes a conveying member rotatably supported by the case main body, and the case main body includes:

a discharge duct part in which the conveying member is housed; and a toner containing part on which the agitating member frictionally slides, and the rib is provided on the toner containing part.

* * * * *